US012179887B2

(12) United States Patent
Champlin et al.

(10) Patent No.: US 12,179,887 B2
(45) **Date of Patent: *Dec. 31, 2024**

(54) MAT STORAGE SYSTEM FOR A BOAT

(71) Applicant: Cobalt Boats, LLC, Neodesha, KS (US)

(72) Inventors: Brett L. Champlin, Midland, TX (US); Michael J. Turner, Bartlesville, OK (US); Timothy W. Kaiser, Independence, KS (US)

(73) Assignee: Cobalt Boats, LLC, Neodesha, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/510,415

(22) Filed: Nov. 15, 2023

(65) Prior Publication Data

US 2024/0239447 A1 Jul. 18, 2024

Related U.S. Application Data

(63) Continuation of application No. 17/732,331, filed on Apr. 28, 2022, now Pat. No. 11,827,316, which is a (Continued)

(51) Int. Cl.
*B63B 29/00* (2006.01)

(52) U.S. Cl.
CPC ..... *B63B 29/00* (2013.01)

(58) Field of Classification Search
CPC ..... B63B 7/08; B63B 29/00; B63B 29/04; B63B 35/73; B63B 35/81; B63B 35/815; (Continued)

(56) References Cited

U.S. PATENT DOCUMENTS 3,016,317 A 1/1962 Brunner
4,324,370 A 4/1982 Guard et al.
(Continued)

FOREIGN PATENT DOCUMENTS

CN 205636405 10/2016
DE 3434405 4/1987
(Continued)

OTHER PUBLICATIONS

Funair, Inflatable lake water mat, https://www.funair.com/pages/inflatable-lake-water-mat, May 17, 2018, 5 pages.
(Continued)

*Primary Examiner* — Daniel V Venne
(74) *Attorney, Agent, or Firm* — Knobbe, Martens, Olson & Bear, LLP

(57) ABSTRACT

A watercraft with a hull assembly and a mat storage system coupled to the hull assembly. The hull assembly may have a mat compartment with the mat storage system configured to move the mat between a stored position, in which at least a portion of the mat is positioned in the mat compartment, and a deployed position. The mat compartment may be positioned beneath at least a portion of a floor of the hull assembly. The hull assembly may have a cover positioned adjacent the mat compartment and moveable between a closed position, in which it covers at least a portion of the mat compartment, and an open position. The mat storage system may have a motor that is configured to move the mat to a stored position.

20 Claims, 10 Drawing Sheets

Related U.S. Application Data continuation of application No. 16/887,116, filed on May 29, 2020, now Pat. No. 11,332,219, which is a continuation of application No. 16/183,195, filed on Nov. 7, 2018, now Pat. No. 10,668,991.

(58) Field of Classification Search

CPC ... B63B 35/816; B63B 35/85; B63B 2007/06; B63B 2029/00; B63B 2029/04; B63B 2035/73; B63B 2035/735; B63B 2035/81; B63B 2035/85; B63B 2709/00; B63B 2722/00; B63B 2723/00; B63B 2728/00

USPC ..... 114/242, 264, 266, 267, 343, 345, 354, 114/364; 441/35, 40, 42, 65, 66, 129, 441/136

See application file for complete search history.

(56) References Cited

U.S. PATENT DOCUMENTS

| | | | | |
|---|---|---|---|---|
| 4,372,243 | A | 2/1983 | Roope, Jr. | |
| 4,471,500 | A | 9/1984 | Long et al. | |
| 6,845,729 | B2 | 1/2005 | Godek | |
| 6,862,756 | B2 | 3/2005 | Mathis | |
| 7,744,436 | B2 | 6/2010 | Pole, III | |
| 9,278,731 | B1 | 3/2016 | Canela | |
| 10,329,000 | B1 | 6/2019 | Foust | |
| 10,370,219 | B2 | 8/2019 | Neuharth et al. | |
| 10,392,084 | B2 | 8/2019 | Wood | |
| 10,668,991 | B1 | 6/2020 | Champlin et al. | |
| 11,332,219 | B2 | 5/2022 | Champlin et al. | |
| 11,364,983 | B2 | 6/2022 | Torzy et al. | |
| 2016/0159437 | A1* | 6/2016 | Pappas | B63H 20/02 114/352 |
| 2018/0035655 | A1 | 2/2018 | Callingham | |

FOREIGN PATENT DOCUMENTS

| | | |
|---|---|---|
| GB | 115754 | 5/2018 |
| IT | 1139886 | 5/1918 |
| KR | 101238936 | 3/2013 |

OTHER PUBLICATIONS

Nuatireel, Nautireel aquatic mat roller, https://naurirell.com/product/nautireel-aquatic-mat-roller/, May 17, 2018, 3 pages.

* cited by examiner

MAT STORAGE SYSTEM FOR A BOAT

CROSS-REFERENCE TO RELATED APPLICATIONS

This application is a continuation of U.S. patent application Ser. No. 17/732,331, filed Apr. 28, 2022, which is a continuation of U.S. patent application Ser. No. 16/887,116, filed May 29, 2020, issued as U.S. Pat. No. 11,332,219, which is a continuation of U.S. patent application Ser. No. 16/183,195, filed Nov. 7, 2018, issued as U.S. Pat. No. 10,668,991, which are hereby incorporated by reference in their entireties and made part of this disclosure. Any and all applications for which a foreign or domestic priority claim is identified in the Application Data Sheet as filed with the present application are hereby incorporated by reference under 37 CFR 1.57.

BACKGROUND OF THE INVENTION

Field of the Invention

The invention relates generally to a storage system for a mat and, in particular, to a mat storage system configured for use with a boat.

Description of the Related Art

Boat passengers often enjoy swimming in the water surrounding the boat after the boat is anchored or moored. When swimming, the passengers may use flotation devices to help them lounge and relax in the water. One type of popular flotation device is a large foam pad. The pad can support a number of people while floating on or near the surface of the water. To transport the pad, it is typically rolled up into a cylinder, and straps or ropes are wrapped around the pad to prevent it from unrolling. When transported on a boat, the rolled pad is typically placed on a swim platform at the rear of the boat, or another suitable location where space exists to accommodate the rolled pad. The pad is fairly large and heavy, which makes it difficult to unroll for use on the water and roll up for storage on the boat. Further, when the pad is rolled and stored on the boat, the rolled pad occupies a large amount of space on the boat and may impede the movement of boat passengers on the boat. For example, when the rolled pad is stored on a swim platform of the boat, the swim platform may be generally unusable without first unrolling the pad or attempting to move the pad to another location on the boat.

BRIEF SUMMARY OF THE INVENTION

A mat storage system in accordance with one embodiment of the invention described herein includes a shaft that is configured to be coupled to a mat. The shaft is configured to rotate to wrap the mat around the shaft. Preferably, the mat is inflatable. A motor is preferably coupled to the shaft for rotating the shaft. The shaft preferably includes a mat engaging structure that is configured to engage a portion of the mat. The mat engaging structure may include a pair of spaced apart openings each configured to receive one of a pair of straps on the mat. The mat may preferably be deployed from the mat storage system and inflated for use to support one or more persons while floating on water. When not in use, the mat may preferably be wrapped around the shaft for storage.

In one embodiment, the mat storage system is used with a watercraft and the shaft is coupled to a hull assembly of the watercraft. The shaft is preferably positioned at least partially in a mat compartment. The hull assembly preferably includes a deck that is coupled to a hull. The deck preferably defines the mat compartment, which is preferably positioned beneath at least a portion of the floor of the deck. The mat compartment is preferably sized for receiving a mat that is wrapped around the shaft. A cover is preferably positioned adjacent the mat compartment and is moveable between a closed position, in which it covers the mat compartment, and an open position, in which the mat compartment is accessible. The mat storage system may preferably be used to compactly store the mat in a manner that does not impede a passenger's movement on the watercraft. The mat may preferably be deployed from the mat storage system and inflated so that it may support one or more passengers of the watercraft while it floats on water adjacent the watercraft.

The invention described herein also encompasses a method of using the mat storage system by coupling an inflatable mat to the shaft, and rotating the shaft to wrap the inflatable mat around the shaft. To deploy the mat for use, the shaft is rotated to unwrap the inflatable mat from the shaft, and the inflatable mat is decoupled from the shaft.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF THE PREFERRED EMBODIMENT

Figure 4:
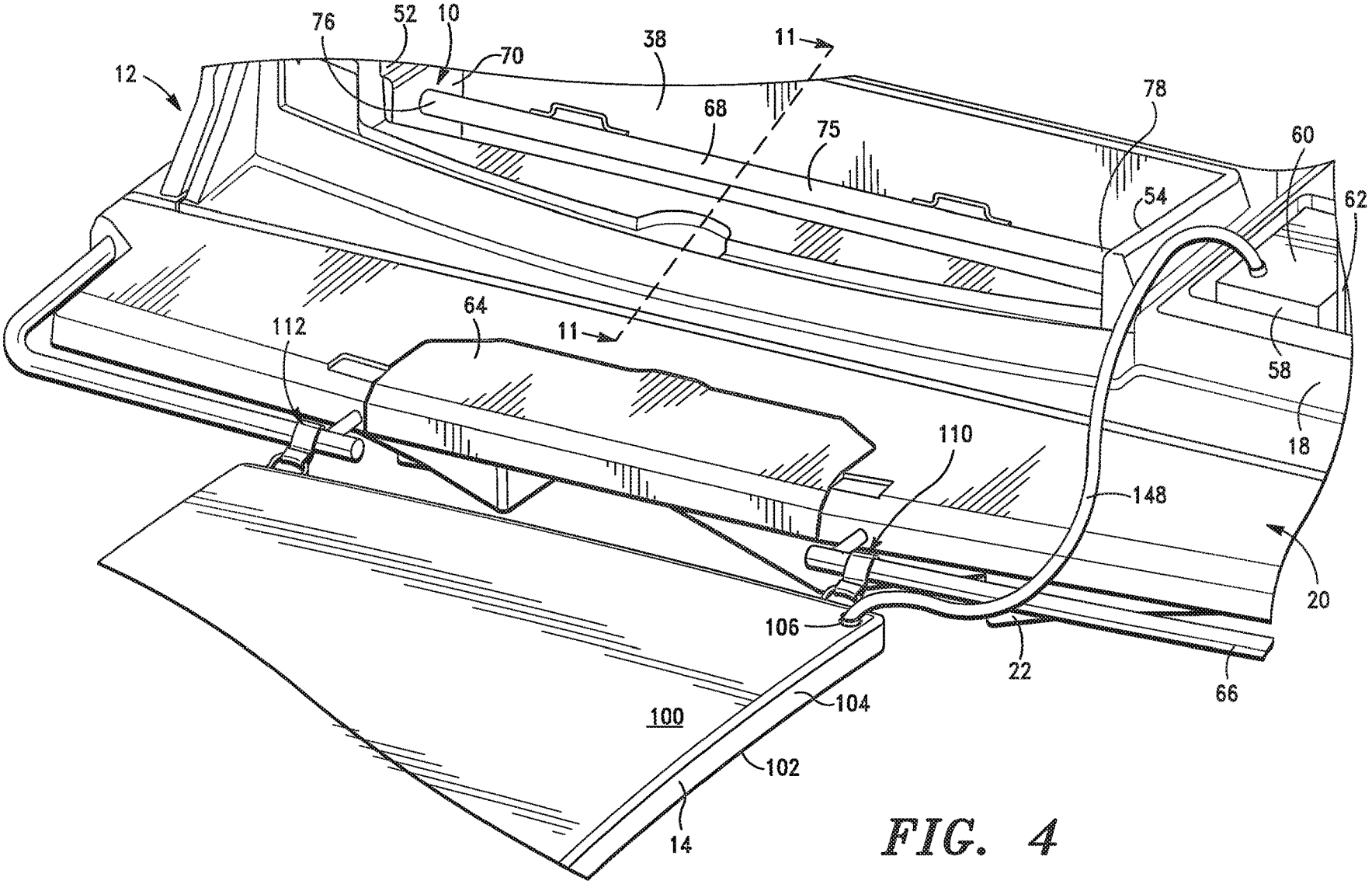
FIG. 4 is a perspective view of a portion of the rear of the boat of FIG. 1 showing the mat coupled to a portion of a swim platform.
Figure 5:
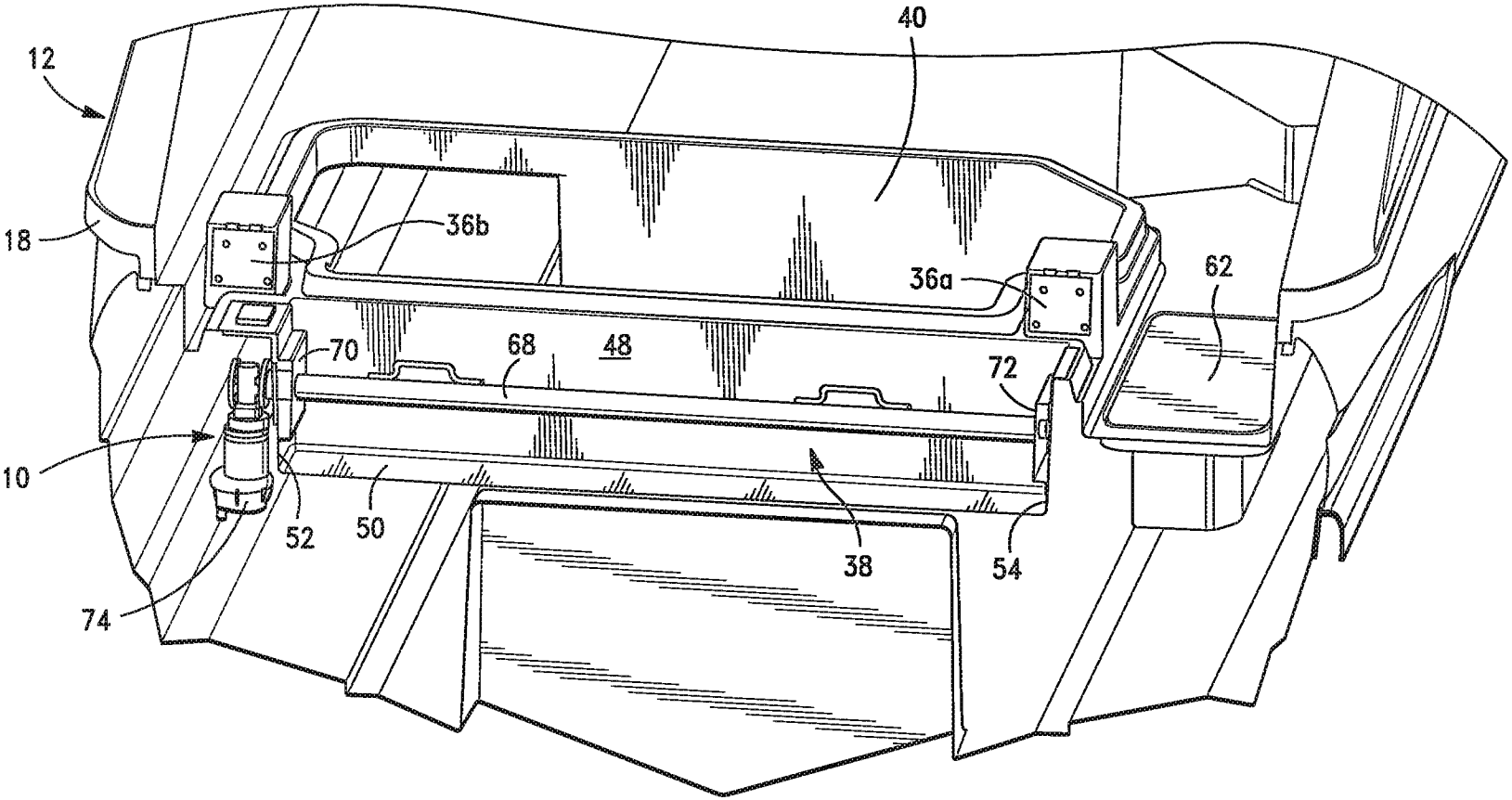
FIG. 5 is a perspective sectional view taken through the line 5-5 in FIG. 2 showing the mat storage system and the mat compartment of the boat with the mat removed for clarity.

A mat storage system in accordance with one embodiment of the invention described herein is identified generally in FIG. 5 as 10. Mat storage system 10 is preferably coupled to and used with a watercraft, such as the boat 12 shown in FIGS. 1-5. As best shown in FIG. 2, mat storage system 10 is preferably configured to store a mat 14 on boat 12 in a relatively compact manner so that the mat 14 does not impede the movement of passengers on boat 12 when stored. Further, mat storage system 10 is preferably configured so that a user may store mat 14 and deploy mat 14 for use (e.g., as shown in FIG. 4) in a relatively easy manner. Mat 14 is configured for floating on water adjacent boat 12 and supporting one or more passengers of boat 12 while floating on the water. Mat 14 is preferably an inflatable mat, as described below and shown in the drawings; however, in at least some embodiments of the invention described herein, mat 14 may be a non-inflatable mat that is configured for floating on water while supporting one or more boat passengers.

Figure 1:
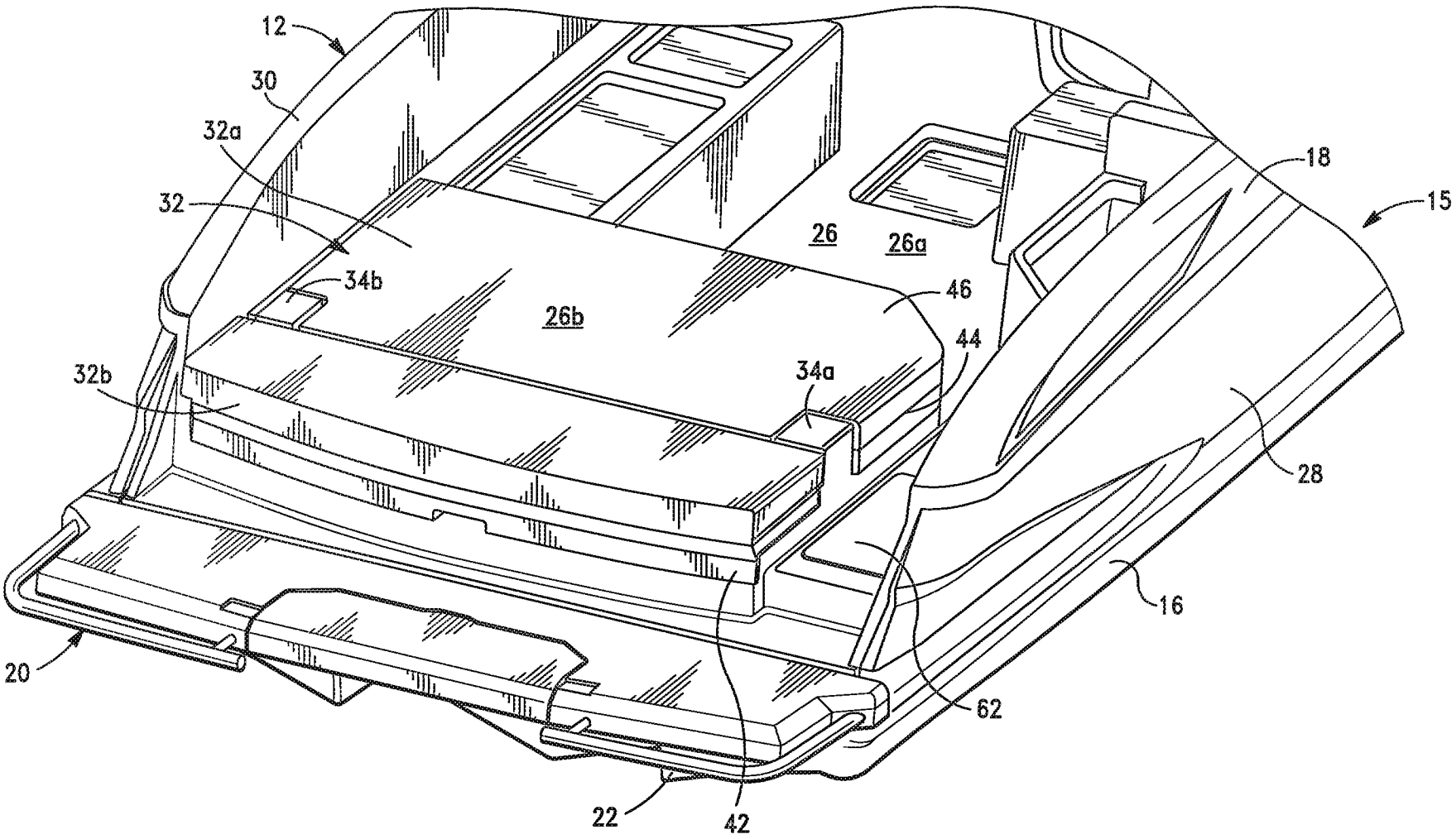
FIG. 1 is a rear perspective view of a boat that includes a mat storage system.
Figure 2:
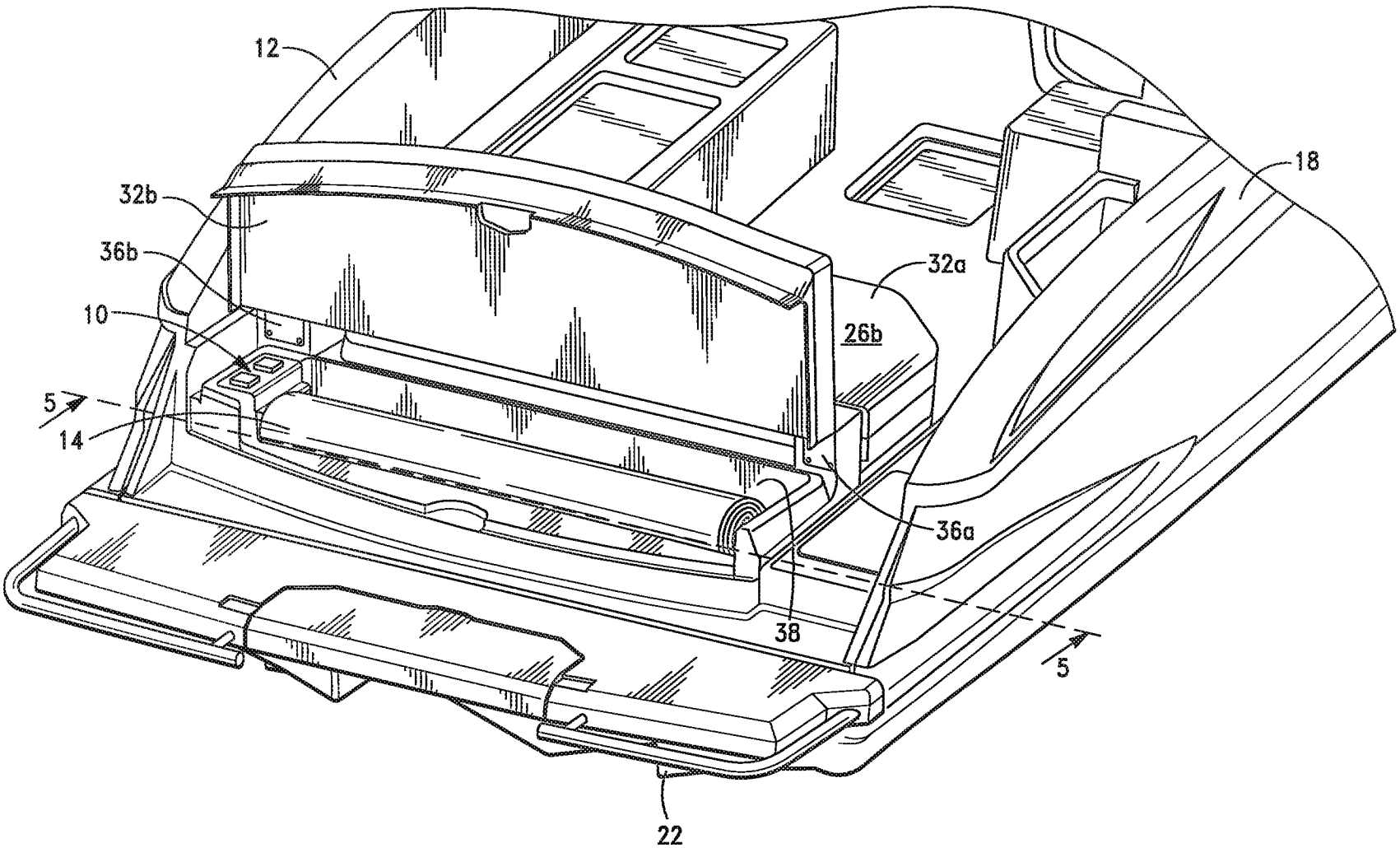
FIG. 2 is a rear perspective view of the boat of FIG. 1 showing a cover of the boat in an open position and a mat positioned within a mat compartment of the boat.

Referring to FIG. 1, the portions of boat 12 that are generally relevant to the invention described herein include a hull assembly 15, which includes a hull 16, and a deck 18 that is coupled to the hull 16. Boat 12 also includes a swim platform 20 that is coupled to at least one of the hull 16 and the deck 18. While hull 16, deck 18, and swim platform 20 are shown in the drawings as separate components that are attached together, it is within the scope of the invention for the hull 16 and deck 18 to be integrally formed together and for the swim platform 20 to be integrally formed together with at least one of the hull 16 and the deck 18. Further, it is within the scope of the invention for boat 12 to not have swim platform 20.

Hull 16 has a stern 22 and a bow (not shown) positioned opposite stern 22. Deck 18 is positioned on top of hull 16. Deck 18 includes a floor 26. The term "floor" is used herein to describe the surface of deck 18 upon which boat passengers stand, sit, or in some instances crawl while moving on deck 18 from stern 22 to bow and from a starboard side 28 of boat 12 to a port side 30. Floor 26 is not necessarily a planar surface at the same elevation from stern 22 to bow and from starboard side 28 to port side 30. For instance, a middle portion 26*a* of floor 26 is at a lower elevation than an aft portion 26*b* of floor 26 when boat 12 is generally horizontal.

Deck 18 also includes a cover 32, which includes an engine compartment section 32*a* and a mat compartment section 32*b*. Mat compartment section 32*b* of cover 32 is joined to two posts 34*a* and 34*b* of deck 18 with hinges 36*a* and 36*b* (shown in FIG. 2 and shown in FIG. 5 without cover 32). Hinges 36*a* and 36*b* allow mat compartment section 32*b* to rotate between the closed position shown in FIG. 1 and the open position shown in FIG. 2. When mat compartment section 32*b* of cover 32 is in the open position, a mat compartment 38 formed in deck 18 is accessible, and when mat compartment section 32*b* is in the closed position, mat compartment 38 is covered or inaccessible. Engine compartment section 32*a* of cover 32 is also preferably joined to a portion of deck 18 with hinges (not shown) that allow engine compartment section 32*a* to rotate between the closed position shown in FIG. 1 and an open position (not shown), in which an engine compartment 40 (FIG. 5) of the boat 12 is accessible. Engine compartment section 32*a* rotates from its closed position to its open position in an opposite direction as mat compartment section 32*b*. Cover 32 may be formed from different materials that are joined together or placed adjacent each other. For example, cover 32 may have a relatively soft top (e.g., made from foam or another suitable material) that is joined to or positioned on top of a more rigid material that is directly joined to hinges 36*a* and 36*b*. Referring to the embodiment shown in FIG. 1, cover 32 may include a first section 42, preferably formed from a rigid material, operable to cover mat compartment 38, a second section 44, preferably formed from a rigid material, operable to cover engine compartment 40, and a soft top 46 that is joined to the first and second sections 42, 44 or merely placed on top of the first and second sections 42, 44 (i.e., the soft top 46 may be removable from engagement with the first and second sections 42, 44). It is within the scope of the invention for first section 42, second section 44, and soft top 46 to be joined together into one integral cover. Further, it is within the scope of the invention for the engine compartment section 32*a* of cover 32 to be omitted, and it is within the scope of the invention for cover 32 to just include the first section 42 operable to cover mat compartment 38. The upper surface of cover 32 forms a portion of the floor 26 of deck 18 in that a boat passenger may walk or crawl across the upper surface of cover 32 to reach the aft most portion of boat 12 and swim platform 20 adjacent stern 22. Cover 32 may also include a backrest (not shown) that is integrated into cover 32 for seating in both forward and aft facing positions.

As shown in FIG. 2, mat compartment 38 is formed by deck 18 and is a recessed compartment in deck 18 that is positioned beneath the aft portion 26*b* of floor 26 and adjacent stern 22. Referring to FIG. 5, deck 18 includes a forward wall 48, a bottom wall 50, side walls 52, 54, and a rear wall 56 (shown in FIGS. 6 & 7) that are joined together to form mat compartment 38. Forward wall 48, bottom wall 50, side walls 52, 54, and rear wall 56 extend beneath the aft portion 26*b* of floor 26 to form mat compartment 38 beneath floor 26 in an area where it does not impede movement of boat passengers from deck 18 to swim platform 20. Mat compartment 38 is preferably sized so that it can contain mat 14 when mat 14 is rolled or coiled as shown in FIG. 2 and mat compartment section 32*b* of cover 32 is in the closed position. Bottom wall 50 includes a drain opening 57 near rear wall 56. A tube 59 places drain opening 57 in fluid communication with an opening 61 in hull 16. Drain opening 57 is positioned so that water within mat compartment 38 (e.g., water draining off a mat 14 positioned within mat compartment 38) preferably drains out of mat compartment 38 and exits boat 12 through drain opening 57, tube 59, and opening 61. A one-way valve or flap (not shown) preferably covers opening 61 to allow water from mat compartment 38 to drain through opening 61 while preventing water surrounding boat 12 from entering mat compartment 38 through opening 61. The positioning of mat compartment 38 adjacent stern 22 facilitates access to mat compartment 38 and mat 14 for a passenger positioned on swim platform 20. While mat compartment 38 is preferably positioned beneath floor 26, it is within the scope of the invention for the mat compartment 38 to be positioned above the floor 26. Further, it is within the scope of the invention for the mat compartment 38 to be positioned in another location of boat 12 other than adjacent stern 22. It is also within the scope of the invention for mat compartment 38 to be formed in another portion of boat 12 besides deck 18, and for mat compartment 38 to be formed from a housing that is separate from boat 12 and that is installed or placed on boat 12.

Referring to FIG. 4, a compressor compartment 58 is formed by deck 18 beneath the aft portion 26*b* of floor 26. Compressor compartment 58 is positioned adjacent mat compartment 38 and the stern 22 of boat 12. Compressor compartment 58 is positioned between mat compartment 38 and the starboard side 28 (FIG. 1) of boat 12. Compressor compartment 58 is preferably sized for receiving and retaining an air compressor 60 that is operable to inflate mat 14. A cover 62 is operable to selectively cover and uncover compressor compartment 58. Cover 62 may be joined to a portion of deck 18 adjacent compressor compartment 58 with one or more hinges (not shown) such that cover 62 is rotatable between a closed position (shown in FIG. 1) covering compressor compartment 58 and an open position (shown in FIG. 4), in which compressor compartment 58 is accessible. Cover 62 is preferably flush with the floor 26 surrounding cover 62 so that a boat passenger may easily walk over the cover 62 when it is in a closed position. While boat 12 preferably includes compressor compartment 58, it is within the scope of the invention for boat 12 to not include compressor compartment 58.

Swim platform 20 extends rearward from the stern 22 of boat 12 to provide a convenient location for entering and exiting water surrounding the boat 12, as is known in the art. Swim platform 20 may include a retractable swim step 64, that is moveable between a stored position, as shown in FIG. 4, and a deployed position (not shown), in which the swim step 64 extends below the water surface rearward of and beneath the rest of swim platform 20. The swim step 64 may be structured and function as described in U.S. Pat. No. 8,375,880. Swim platform 20 includes a bar 66 that extends around a majority of a peripheral edge of swim platform 20. Bar 66 is preferably joined to the remainder of swim platform 20 at discrete locations such that the majority of bar 66 is spaced from the remainder of swim platform 20. The spacing allows a person in the water adjacent swim platform 20 to grab bar 66 as they are entering and exiting the water or as they are swimming near boat 12. Bar 66 is formed in two sections, with one section on one side of swim step 64, and one section on the other side of swim step 64. It is within the scope of the invention for swim platform 20 to not include a swim step 64, and for bar 66 to continuously extend around the peripheral edge of swim platform 20.

Boat 12 preferably includes other features that are not shown in the drawings for clarity or described in detail herein (e.g., an engine, a propeller, a cockpit and controls, and seats). It is within the scope of the invention for mat storage system 10 to be used with and installed on other types of boats and watercraft (e.g., yachts, deck boats, or personal watercraft) other than the boat 12 described herein.

Referring to FIGS. 4 and 5, mat storage system 10 includes a shaft 68 that is rotatably mounted to side walls 52 and 54 with shaft mounts 70 and 72 (FIG. 5), respectively, and a motor 74 that is coupled to shaft 68 and operable to rotate shaft 68. Shaft 68 and motor 74 are positioned beneath the aft portion 26*b* (FIG. 1) of floor 26 adjacent stern 22. The majority of shaft 68 is positioned within mat compartment 38 with a portion of shaft 68 extending through side wall 52 to motor 74. Motor 74 is positioned in a cavity of boat 12 between hull 16 and deck 18 adjacent mat compartment 38.

Figure 6:
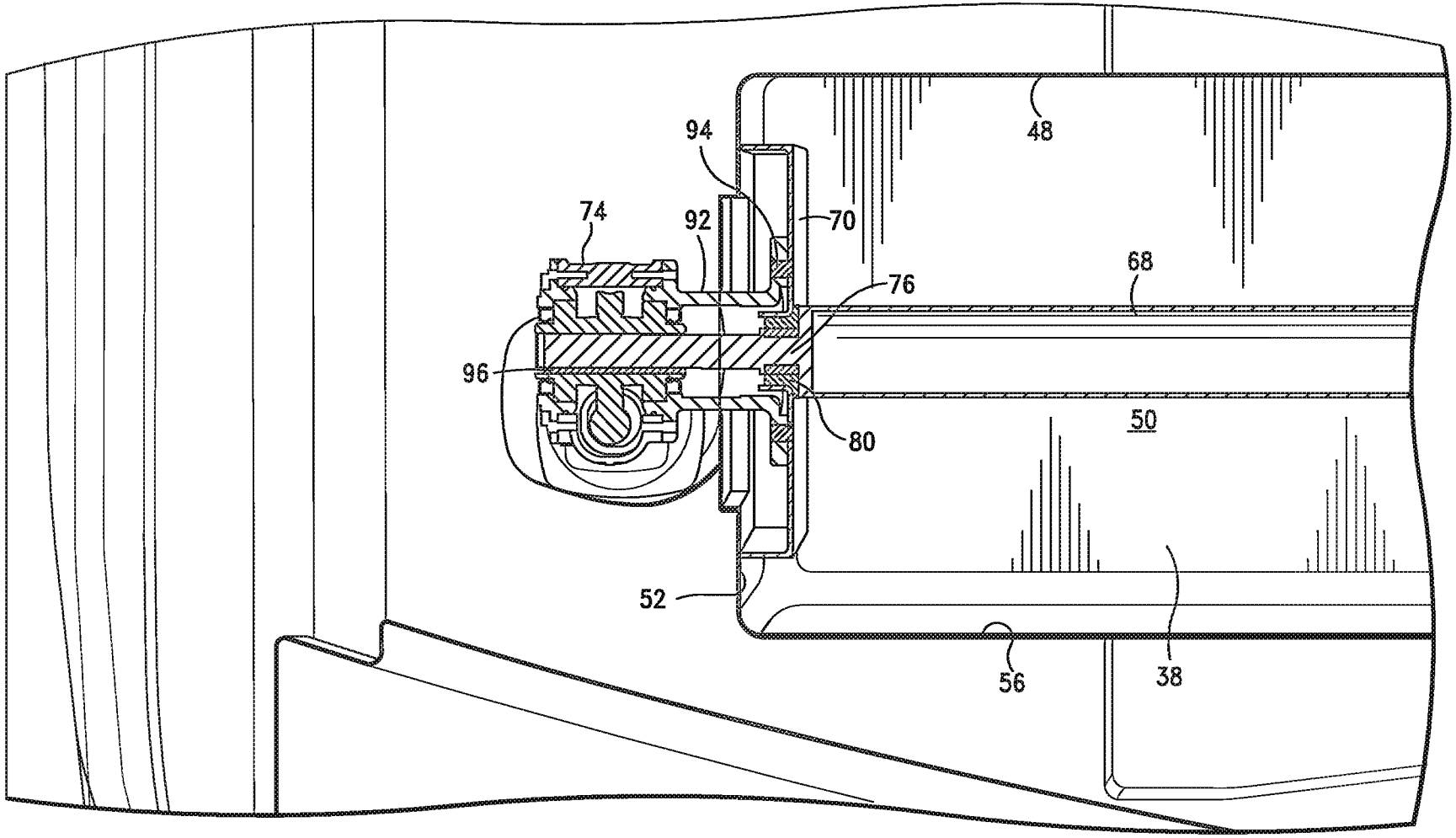
FIG. 6 is a top sectional view of a portion of the boat of FIG. 1 showing a motor of the mat storage system coupled to a first end of the shaft.
Figure 7:
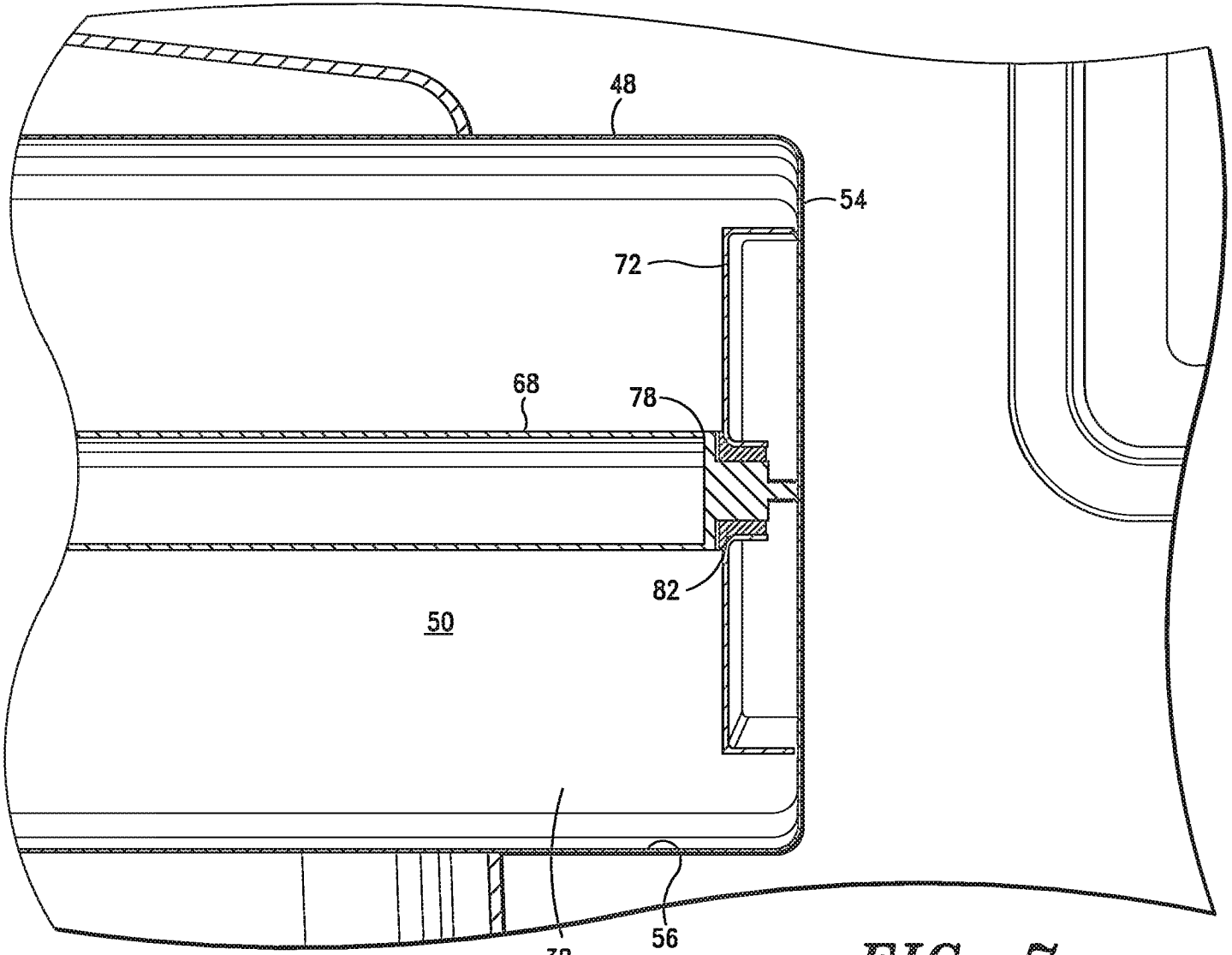
FIG. 7 is a top sectional view of a portion of the boat of FIG. 1 showing a second end of the shaft coupled to the boat.

Referring to FIG. 4, shaft 68 has a generally cylindrical outer surface 75 that extends from a first end 76 of shaft 68 to a second end 78 of shaft 68. As shown in FIG. 6, first end 76 of shaft 68 extends through a bushing 80 mounted in an opening of shaft mount 70 to rotatably couple shaft 68 to shaft mount 70. As shown in FIG. 7, second end 78 of shaft 68 extends through a bushing 82 mounted in an opening of shaft mount 72 to rotatably couple shaft 68 to shaft mount 72. Each of shaft mounts 70 and 72 is preferably coupled to deck 18 with a plurality of fasteners (not shown).

Figure 3:
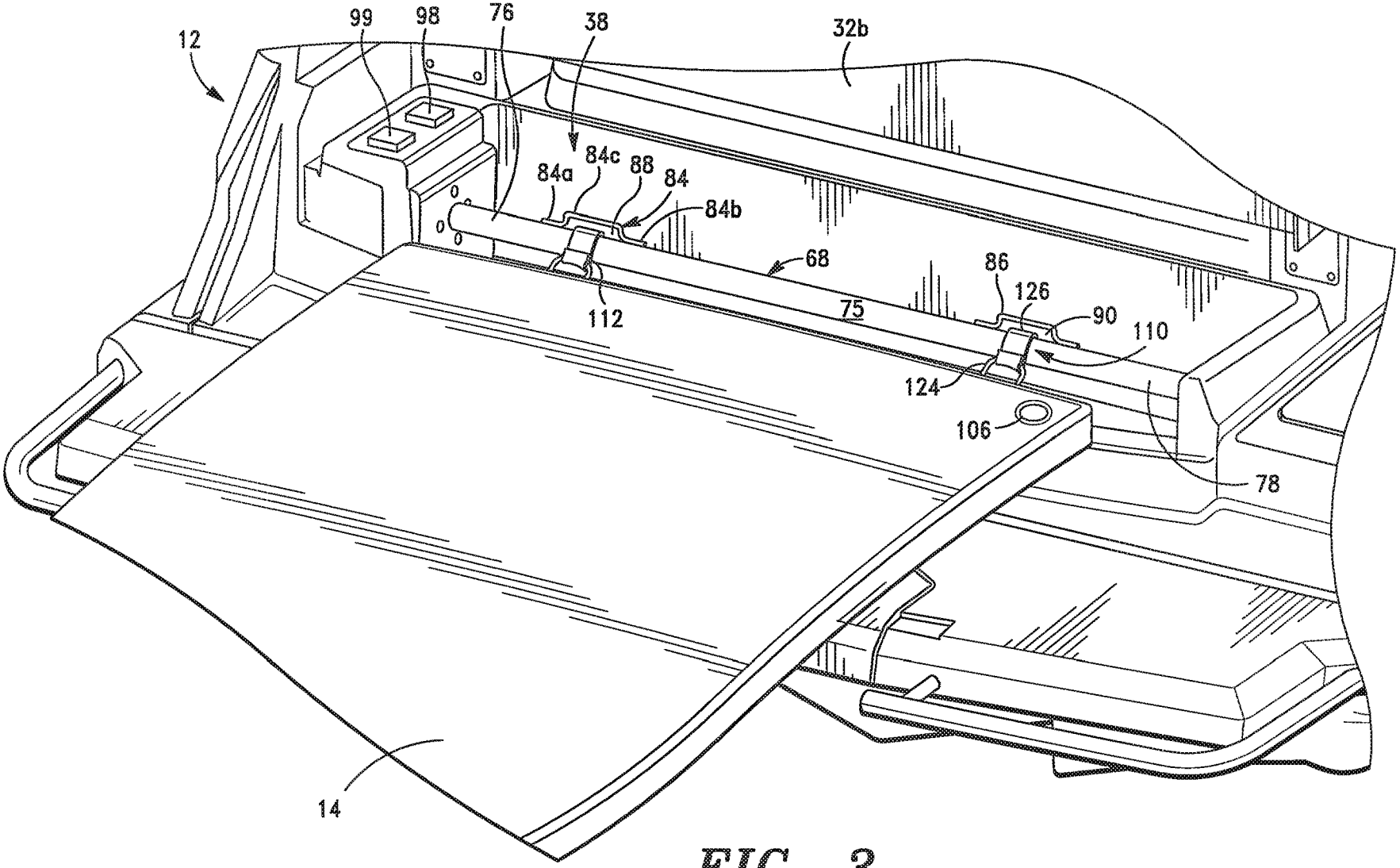
FIG. 3 is a perspective view of a portion of the rear of the boat of FIG. 1 showing the mat coupled to a shaft of the mat storage system.

As shown in FIG. 3, shaft 68 has a mat engaging structure consisting of outer surface 75 of shaft 68, and a first bar 84 and a second bar 86 that are each joined to outer surface 75. The first bar 84 is joined to outer surface 75 at its ends 84*a,b*. A middle portion 84*c* of first bar 84 is bent away from outer surface 75 into a U-shape to define an opening 88 between the first bar 84 and outer surface 75. Second bar 86 is configured in a similar manner as first bar 84 such that an opening 90 is positioned between second bar 86 and outer surface 75. First bar 84 is positioned approximately equidistant from both the longitudinal center of shaft 68 and the first end 76 of shaft 68, and second bar 86 is positioned approximately equidistant from the longitudinal center of shaft 68 and the second end 78 of shaft 68. Cover 32 covers shaft 68 when cover 32 is in its closed position (FIG. 1), and shaft 68 is accessible when cover 32 is in its open position (FIG. 3). Instead of first and second bars 84, 86 joined to the outer surface 75 of shaft 68, it is within the scope of the invention for the mat engaging structure to be formed integrally into the outer surface 75 of shaft 68. For example, the mat engaging structure may be a hole extending through shaft 68 that is configured to receive a portion of mat 14. Further, the mat engaging structure may be another type of engaging structure joined to the outer surface 75 of shaft 68. For example, the mat engaging structure may include hook or loop material or snap fastener(s) joined to outer surface 75. The mat engaging structure may alternatively just include the outer surface 75 of shaft 68 itself without first bar 84 and second bar 86.

Referring to FIG. 6, motor 74 includes a mounting collar 92 that extends through side wall 52 and is mounted to shaft mount 70 with a plurality of fasteners, one of which is identified as 94. The first end 76 of shaft 68 is coupled to motor 74 with a key 96 that allows motor 74 to rotate shaft 68 when powered on. A switch 98 (shown in FIG. 3) is electrically coupled to motor 74 and is operable to turn motor 74 on so that motor 74 rotates in a first direction when switch 98 is depressed. Another switch 99 is electrically coupled to motor 74 and is operable to turn motor 74 on so that motor 74 rotates in a second direction that is opposite to the first direction when switch 99 is depressed. Switches 98 and 99 are preferably located where a boat passenger may step on switches 98 and 99 to depress them and activate motor 74. Although switches 98 and 99 are shown as being located above motor 74 adjacent mat compartment 38 and floor 26, switches 98 and 99 may be positioned in other locations on boat 12. Further, switches 98 and 99 may be replaced with a single switch (e.g., a three position toggle switch) that allows motor 74 to either be turned off, rotate in a first direction, or rotate in a second direction opposite to the first direction. Although motor 74 is preferably used to rotate shaft 68, it is within the scope of the invention for mat storage system 10 to not have motor 74, in which case a handle would preferably be coupled to shaft 68 for manual rotation of shaft 68.

Figure 8:
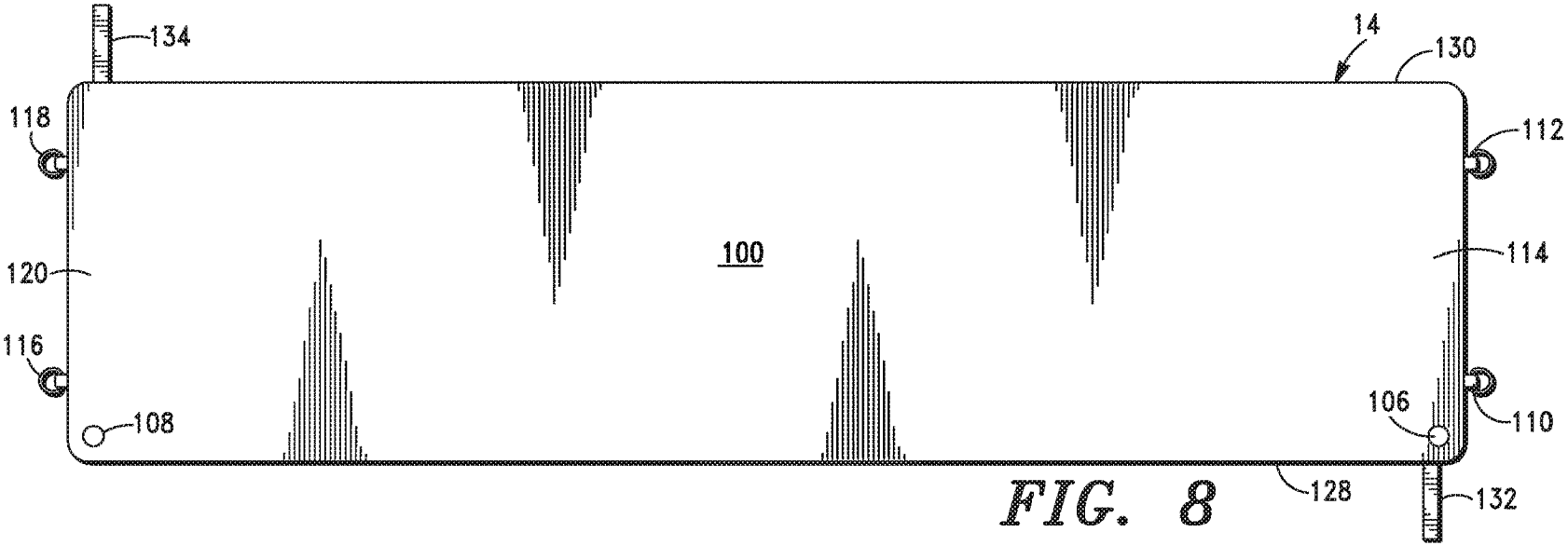
FIG. 8 is a top plan view of the mat shown in FIG. 2 when unrolled from the mat storage system.
Figure 9:
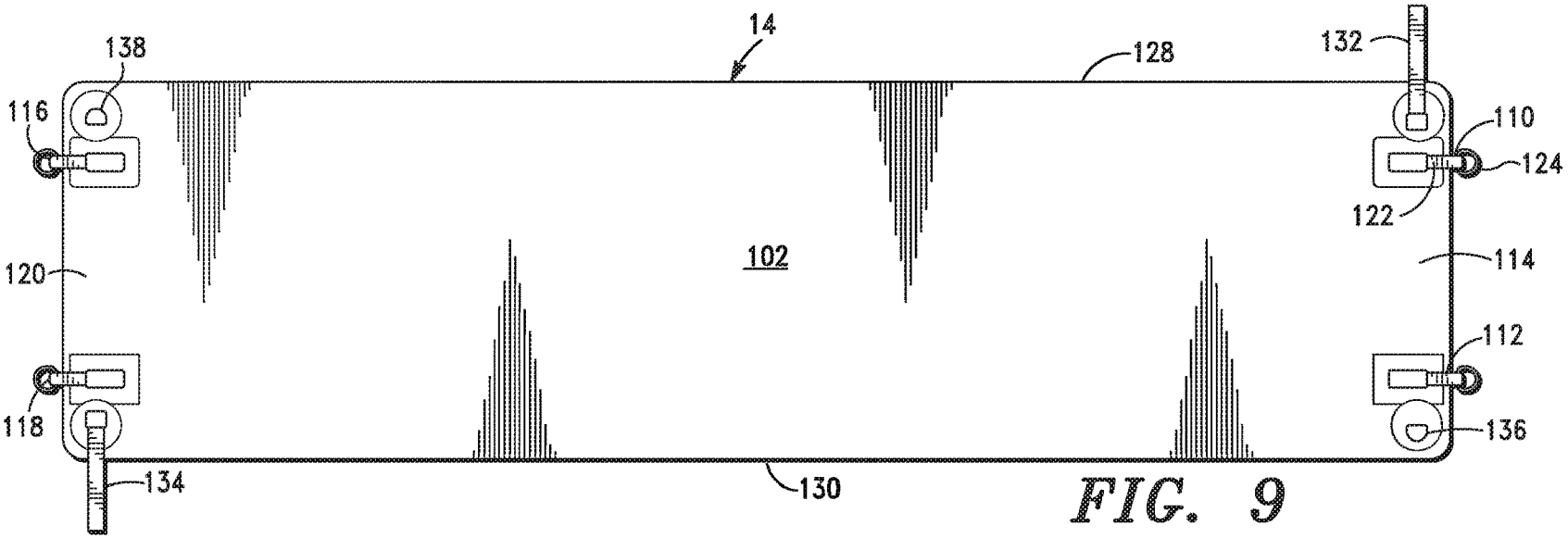
FIG. 9 is a bottom plan view of the mat of FIG. 8.

As shown in FIGS. 8 and 9, mat 14 has a rectangular shape with a length exceeding its width when mat 14 is unrolled into a generally planar orientation. Mat 14 has an upper surface 100, shown in FIG. 8, and a lower surface 102, shown in FIG. 9. When inflated with air, as shown in FIG. 4, a side wall 104 of mat 14 extends from the upper surface 100 to the lower surface 102. The upper surface 100, lower surface 102, and side wall 104 in combination form an exterior surface of mat 14. The upper surface 100, lower surface 102, and side wall 104 may be integrally formed from one sheet of material or formed from a plurality of sheets of material that are joined together. The upper surface 100, lower surface 102, and side wall 104 enclose an interior space (not shown) configured to receive air for expanding the mat 14 so that it may support one or more persons when floating on water.

Valves 106 and 108 (FIG. 8) are coupled to upper surface 100 at opposite ends of mat 14. Valves 106 and 108 are both in fluid communication with the interior space enclosed by upper surface 100, lower surface 102, and side wall 104. As is generally known in the art, valves 106 and 108 are configured to receive air for inflating mat 14 and retain the air within mat 14. When it is desired to deflate mat 14, the valves 106 and 108 may selectively be actuated to release air from mat 14.

As best shown in FIG. 9, mat 14 includes two straps 110 and 112 that are each coupled to lower surface 102 adjacent a first end 114 of mat 14, and mat 14 includes two straps 116 and 118 that are each coupled to lower surface 102 adjacent a second end 120 of mat 14. Each of the straps 110, 112, 116, and 118 are substantially similar. Accordingly, only strap 110 is described in detail herein. Strap 110 includes an elongate strip 122 that is joined at both ends to the lower surface 102 of mat 14 to form a loop. AD-ring 124 is received by the loop formed by the elongate strip 122. Referring to FIG. 3, another elongate strip 126 is received by the D-ring 124. Elongate strip 126 may be looped through D-ring 124 and stitched to itself to permanently attach it to D-ring 124. Alternatively, elongate strip 126 may include releasable fasteners, such as hook and loop material or snap fasteners, that allow elongate strip 126 to be removably coupled to D-ring 124. Elongate strip 126 preferably includes releasable fasteners that allow it to removably engage outer surface 75 of shaft 68 for coupling mat 14 to shaft 68. For example, one section of elongate strip 126 may include hook material or a first snap fastener and another section may include loop material or a second snap fastener such that elongate strip 126 can removably engage shaft 68 by: inserting the elongate strip 126 through the opening 90 between second bar 86 and the outer surface 75 of shaft 68, folding elongate strip 126 around the outer surface 75 of shaft 68, and releasably coupling the hook material or the first snap fastener of elongate strip 126 to the loop material or the second snap fastener of elongate strip 126. FIG. 3 generally shows elongate strip 126 coupled to shaft 68 in this manner. By inserting elongate strip 126 through opening 90, second bar 86 retains elongate strip 126 in position on shaft 68 when elongate strip 126 is wrapped around shaft 68 to engage shaft 68 (i.e., second bar 86 restricts lateral movement of elongate strip 126 with respect to shaft 68). Releasable fasteners on elongate strip 126 may allow it to be removably coupled to both D-ring 124 and to shaft 68 at the same time. Strap 112 is preferably operable to be removably coupled to shaft 68 in a similar manner as described above with respect to strap 110. Further, if mat 14 is oriented so that straps 116 and 118 are positioned adjacent shaft 68, straps 116 and 118 are preferably operable to be removably coupled to shaft 68, respectively, in a similar manner as described above with respect to strap 110. Straps 110 and 112 are also operable to removably engage bar 66 on swim platform 20, as shown in FIG. 4, in a similar manner as described above with respect to the engagement between strap 110 and shaft 68. Straps 116 and 118 may also removably engage bar 66 in a similar manner as shown in FIG. 4 with respect to straps 110 and 112. Further, boat 12 may include other types of strap engagement structures other than bar 66 that are operable to engage straps 110, 112, 116, and 118 for retaining mat 14 near boat 12 while mat 14 floats on water adjacent the boat 12.

As shown in FIG. 8, strap 110 is positioned adjacent a first side 128 of mat 14, and strap 112 is positioned adjacent a second side 130 of mat 14. Straps 110 and 112 are preferably spaced apart a distance that corresponds to the distance between the first and second bars 84, 86 of shaft 68, as shown in FIG. 3, so that straps 110 and 112 can easily be received by openings 88 and 90. By positioning portions of straps 110 and 112 through openings 88 and 90 when the straps 110 and 112 wrap around shaft 68 to engage shaft 68, first and second bars 84, 86 generally retain straps 110 and 112 in position on shaft 68 to prevent substantial lateral movement of mat 14 with respect to shaft 68. Straps 116 and 118 are also preferably spaced apart approximately the same distance as bars 84, 86. It is within the scope of the invention for shaft 68 to have another type of mat engaging structure other than outer surface 75 and first and second bars 84, 86. For example, shaft 68 may include snap fasteners that engage mating snap fasteners on straps 110, 112, 116, and 118, or shaft 68 may include hook or loop material that engages mating hook or loop material on straps 110, 112, 116, and 118. Further, it is within the scope of the invention for mat 14 to have something other than straps 110, 112, 116, and 118 that are designed to engage a mat engaging structure of shaft 68. For example, releasable fasteners may be directly attached to or integrated within upper surface 100, lower surface 102, or side wall 104 of mat 14, wherein such releasable fasteners are operable to releasably engage mating releasable fasteners of shaft 68.

Figure 10:
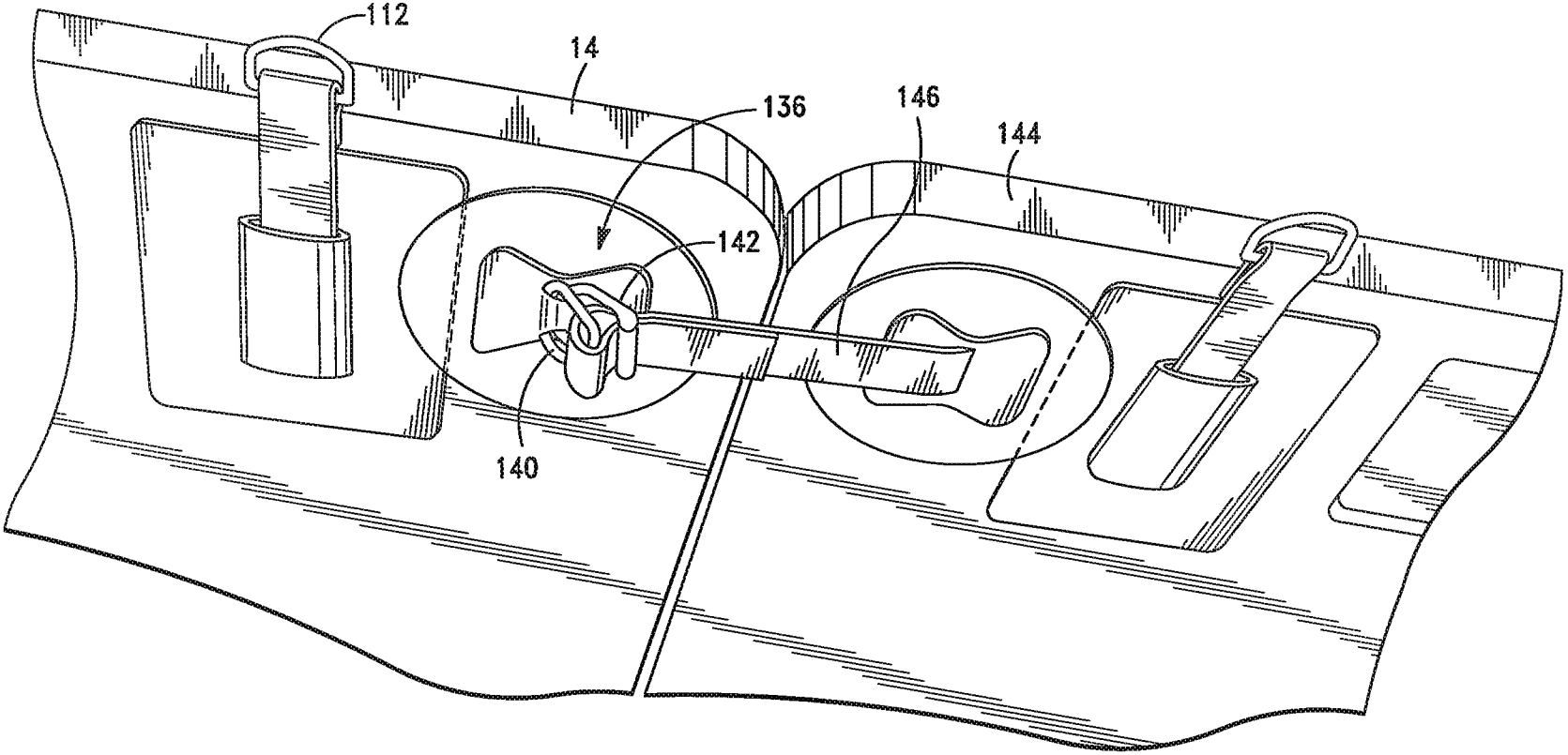
FIG. 10 is a perspective view of a portion of the bottom of the mat of FIG. 8 showing it coupled to another similar mat.
Figure 11:
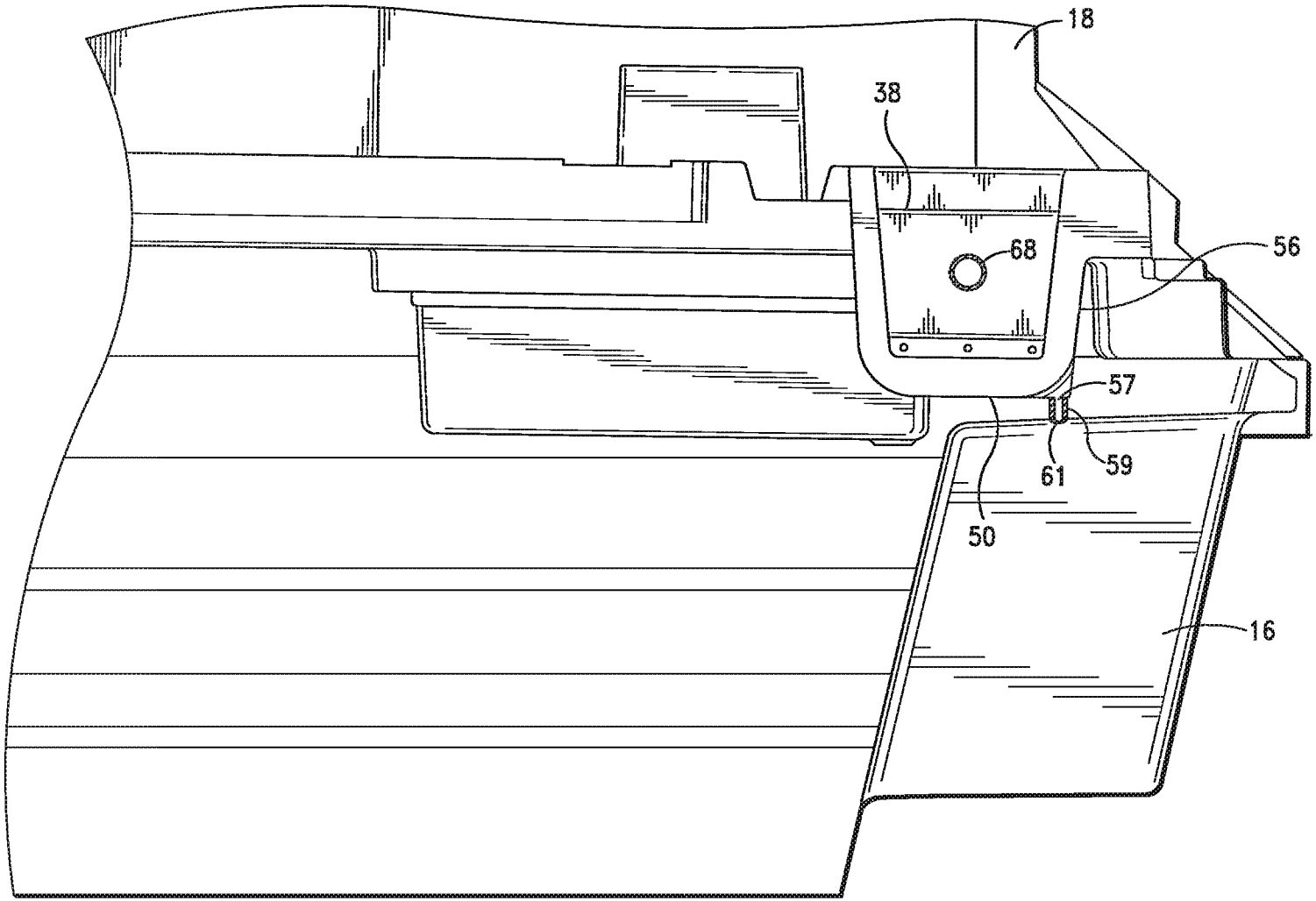
FIG. 11 is a cross-sectional view taken through the line 11-11 in FIG. 4.

Referring to FIG. 9, mat 14 includes straps 132 and 134 that extend laterally outward from mat 14. Strap 132 is coupled to lower surface 102 adjacent first end 114 and is operable to extend laterally outward beyond first side 128, and strap 134 is coupled to lower surface 102 adjacent second end 120 and is operable to extend laterally outward beyond second side 130. Mat 14 also includes two loop assemblies 136 and 138 that are coupled to lower surface 102. Each loop assembly 136 and 138 preferably includes two D-rings, as shown in FIG. 10 with respect to loop assembly 136, which includes D-rings 140 and 142. Loop assembly 136 is positioned in the corner of mat 14 adjacent first end 114 and second side 130, and loop assembly 138 is positioned in an opposite corner of mat 14 adjacent second end 120 and first side 128. Straps 132 and 134 and loop assemblies 136 and 138 may be used to releasably couple two mats 14 together to form a larger floatable surface on which boat passengers may sit or lay. For example, FIG. 10 shows mat 14 releasably coupled to an adjoining mat 144 that is preferably substantially similar to mat 14. Mat 144 includes a strap 146 that extends laterally outward beyond one side of mat 144 to engage loop assembly 136 of mat 14. Strap 146 may engage loop assembly 136 by: placing the free end of strap 146 through each of D-rings 140 and 142, looping the free end of strap 146 over D-ring 140, placing the free end of strap 146 back through D-ring 142, and then pulling on the free end of strap 146 until mats 14 and 144 abut each other. Mat 144 preferably includes a loop assembly (not shown) at the opposite end of mat 144 that is shown in FIG. 10 that is configured to releasably engage strap 134 (FIG. 9) of mat 14 in a similar manner as described above with respect to strap 146 and loop assembly 136. Any number of mats, similar to mat 14, may be joined together in this manner.

Air compressor 60, shown in FIG. 4, includes a hose 148 that is coupled to an outlet of the air compressor 60. Hose 148 preferably has a length that is sufficient to reach valve 106 of mat 14 when mat 14 engages bar 66 of swim platform 20. The free end of hose 148 is preferably capable of releasably engaging either valve 106 or valve 108 of mat 14 in a manner that allows hose 148 to deliver air to the interior of mat 14. Air compressor 60 preferably includes a switch or button (not shown) to turn on air compressor 60 so that it begins delivering pressurized air through hose 148. Air compressor 60 is preferably configured so that it can sense the pressure of the air within mat 14 and turn off when the air pressure reaches a desired air pressure.

In use, to store mat 14 on boat 12 with the mat storage system 10, mat compartment section 32*b* of cover 32 is first lifted up to the open position shown in FIG. 3 so that mat compartment 38 is accessible. Mat 14 is coupled to shaft 68 by engaging straps 110 and 112 of mat 14 with the mat engaging structure of shaft 68, i.e., by wrapping straps 110 and 112 around the outer surface 75 of shaft 68 so that the straps 110 and 112 are positioned through the openings 88 and 90 formed by first and second bars 84 and 86. Switch 98 is then depressed to turn on motor 74 so that shaft 68 rotates. As shaft 68 rotates, mat 14 wraps around shaft 68 in a coil shape. A boat passenger preferably guides mat 14 as shaft 68 rotates and the mat 14 wraps around shaft 68. Further, as mat 14 wraps around shaft 68, one or both of valves 106, 108 are preferably open so that air contained within mat 14 exhausts from mat 14 to deflate the mat 14. Deflation of mat 14 allows it to be stored around shaft 68 in a relatively compact shape and generally reduces the volume of space needed for mat compartment 38. Once mat 14 is fully wrapped around shaft 68, as shown in FIG. 2, mat compartment section 32*b* of cover 32 may be closed to store mat 14 on boat 12.

To unwrap mat 14 for use, mat compartment section 32*b* of cover 32 is lifted to access mat 14. The free end of mat 14 not coupled to shaft 68 is located and pulled out of mat compartment 38. Switch 99 is then depressed to turn on motor so that shaft 68 rotates in a direction that unwraps mat 14 from shaft 68. A boat passenger preferably pulls on and guides the mat 14 as it unwraps from shaft 68 into the position shown in FIG. 3. Mat 14 is then decoupled from shaft 68 by disengaging straps 110 and 112 from shaft 68. Mat 14 is coupled to bar 66 of swim platform 20, as shown in FIG. 4, by engaging straps 110 and 112 with bar 66 as described above. Mat 14 is then inflated by coupling hose 148 to valve 106 and turning on air compressor 60. Air compressor 60 preferably turns off when an air pressure within mat 14 reaches a desired air pressure. Hose 148 is decoupled from valve 106, and valve 106 is closed. Mat 14 then floats on water adjacent boat 12 so that one or more boat passengers may be supported on mat 14 as it floats on the water.

When it is desired to store mat 14 again, mat 14 may be partially deflated using one or both of valves 106 and 108 before mat 14 is coupled to and wrapped around shaft 68 as described above.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed is:

1. A watercraft with stern-available compressed air for inflating a recreational mat, the watercraft comprising:

a mat compartment disposed at a stern of the watercraft, the mat compartment configured to house at least a portion of a recreational mat in a stored configuration;

a compressor compartment disposed at the stern of the watercraft, the compressor compartment comprising a cover rotatable between a closed position and an open position in which an interior of the compressor compartment is accessible; and an air compressor configured to be disposed in the compressor compartment and to deliver pressurized air to inflate the recreational mat, the air compressor comprising a hose with a length to couple the hose to a valve of the recreational mat with the air compressor disposed in the compressor compartment and the recreational mat deployed in water, wherein the air compressor is configured to sense pressure within the recreational mat and cease delivering pressurized air when a pressure is reached.

2. The watercraft of claim 1, wherein the cover is configured to be flush with a floor of the watercraft in the closed position.

3. The watercraft of claim 1, wherein the cover is coupled to a portion of a deck of the watercraft with one or more hinges.

4. The watercraft of claim 1, wherein the compressor compartment is adjacent the mat compartment.

5. The watercraft of claim 1, wherein the compressor compartment is disposed between the mat compartment and a starboard side of the watercraft.

6. The watercraft of claim 1, wherein the recreational mat is coupled to a swim platform of the watercraft when deployed in water.

7. A watercraft with stern-available compressed air for inflating a recreational mat, the watercraft comprising:

a compressor compartment disposed at a stern of the watercraft, the compressor compartment comprising a cover maneuverable between a closed position and an open position in which an interior of the compressor compartment is accessible; and an air compressor configured to be disposed in the compressor compartment and to deliver pressurized air to inflate a recreational mat, the air compressor comprising a hose with a length to couple the hose to a valve of the recreational mat with the air compressor disposed in the compressor compartment and the recreational mat deployed in water, wherein the air compressor is configured to sense pressure within the recreational mat and cease delivering pressurized air when a pressure is reached.

8. The watercraft of claim 7, wherein the cover is configured to be flush with a floor of the watercraft in the closed position.

9. The watercraft of claim 7, wherein the cover is coupled to a portion of a deck of the watercraft with one or more hinges.

10. The watercraft of claim 7, further comprising a mat compartment disposed at the stern of the watercraft, the mat compartment configured to house at least a portion of the recreational mat in a stored configuration.

11. The watercraft of claim 10, wherein the compressor compartment is adjacent the mat compartment.

12. The watercraft of claim 10, wherein the compressor compartment is disposed between the mat compartment and a starboard side of the watercraft.

13. The watercraft of claim 7, wherein the recreational mat is coupled to a swim platform of the watercraft when deployed in water.

14. A watercraft with stern-available compressed air for inflating a recreational mat, the watercraft comprising:

a compressor compartment disposed at a stern of the watercraft, the compressor compartment comprising a cover maneuverable between a closed position and an open position in which an interior of the compressor compartment is accessible; and an air compressor configured to be disposed in the compressor compartment and to deliver pressurized air to inflate a recreational mat, wherein the air compressor is configured to sense pressure within the recreational mat and cease delivering pressurized air when a pressure is reached.

15. The watercraft of claim 14, wherein the air compressor comprises a hose with a length to couple the hose to a valve of the recreational mat with the air compressor disposed in the compressor compartment and the recreational mat deployed in water and coupled to a swim platform of the watercraft.

16. The watercraft of claim 14, wherein the cover is configured to be flush with a floor of the watercraft in the closed position.

17. The watercraft of claim 14, wherein the cover is coupled to a portion of a deck of the watercraft with one or more hinges.

18. The watercraft of claim 14, further comprising a mat compartment disposed at the stern of the watercraft, the mat compartment configured to house at least a portion of the recreational mat in a stored configuration.

19. The watercraft of claim 18, wherein the compressor compartment is adjacent the mat compartment.

20. The watercraft of claim 18, wherein the compressor compartment is disposed between the mat compartment and a starboard side of the watercraft.

* * * * *